US005957675A

United States Patent [19]

Buehrer et al.

[11] Patent Number: 5,957,675

[45] Date of Patent: Sep. 28, 1999

[54] THICK MATTER PUMP WITH A CLEANING CARTRIDGE AND BLOCKING SLIDE

[75] Inventors: Klaus Buehrer, Bernhausen; Hellmut Hurr, Reutlingen, both of Germany

[73] Assignee: Putzmeister Aktiengesellschaft, Aichtal, Germany

[21] Appl. No.: 08/718,374

[22] PCT Filed: Apr. 21, 1995

[86] PCT No.: PCT/EP95/01516

§ 371 Date: Sep. 27, 1996

§ 102(e) Date: Sep. 27, 1996

[87] PCT Pub. No.: WO95/30088

PCT Pub. Date: Nov. 9, 1995

[30] Foreign Application Priority Data

Apr. 28, 1994 [DE] Germany ..... 44 14 845

[51] Int. Cl.[6] ..... F04B 15/02

[52] U.S. Cl. ..... 417/519; 15/104.06

[58] Field of Search ..... 15/166–70, 104.06, 15/3.51; 210/134, 23; 417/517, 900, 203, 519; 92/244; 165/95; 103/49

[56] References Cited

U.S. PATENT DOCUMENTS

| | | | |
|---|---|---|---|
| 3,063,079 | 11/1962 | Bergman et al. | 15/104.06 |
| 3,146,477 | 9/1964 | Bergman et al. | 15/104.06 |
| 3,543,324 | 12/1970 | Knapp et al. | 15/104.06 |
| 4,373,225 | 2/1983 | Ecardstein et al. | 15/104.06 |

FOREIGN PATENT DOCUMENTS

| | | |
|---|---|---|
| 19 27 501 | 11/1965 | Germany . |
| 29 27 324 | 1/1981 | Germany . |
| 2943967A1 | 5/1981 | Germany . |
| 3229103C1 | 3/1984 | Germany . |
| 3430193A1 | 2/1986 | Germany . |
| 4323796A1 | 1/1994 | Germany . |
| 58-113589 | 7/1983 | Japan . |
| 59-190485 | 10/1984 | Japan . |
| 60-56186 | 4/1985 | Japan . |
| 3149360 | 6/1991 | Japan . |
| 597 513 | 4/1978 | Switzerland . |

*Primary Examiner*—Timothy S. Thorpe
*Assistant Examiner*—Robert Evora
*Attorney, Agent, or Firm*—Flynn, Thiel, Boutell & Tanis, P.C.

[57] ABSTRACT

A thick matter pump, especially a concrete pump, including a material feed container, two conveyor cylinders opening at the front into the inside of the material feed container, a swivelling pipe, one end of which alternately in pulses communicates with the frontal apertures in the conveying cylinder and the other end being connected to a conveyor pipe and with a closable cleaning aperture in the appropriate pipe wall arranged near the end of the conveyor pipe or in a section of the swivelling pipe outside the material feed container. A cleaning cartridge can be connected to the cleaning aperture having a compressed air and/or pressurized water connection while the feed pipe and/or the swivelling pipe can be closed on the conveyor cylinder side by means of a blocking system.

18 Claims, 6 Drawing Sheets

92
90
88
86
96
42
40
84
82
80
16
14
10
28
26
46
70
72
110
112
88''

THICK MATTER PUMP WITH A CLEANING CARTRIDGE AND BLOCKING SLIDE

CONTINUATION INFORMATION

This is a rule 371 application of PCT/EP95/01516 filed on Apr. 4, 1995.

FIELD OF THE INVENTION

The invention relates to a thick matter pump with a material feed container, two hydraulically driven conveyor cylinders ending with their front-side openings opening into the inside of the material feed container, a swivelling pipe extending into the material feed container, communicating with its one end alternately in pulses with the front-side openings in the conveyor cylinders, and being connected with its other end to a conveyor pipe.

BACKGROUND OF THE INVENTION

Thick matter pumps of this type are mainly utilized for conveying of concrete and more or less viscous sludge. The pipelines of the thick matter pump and of the material feed containers must therefore be emptied and cleaned at the end of a conveying operation. The conveyor pipeline, which in concrete pumps is usually fastened on a distributor mast, can be emptied either by sucking the concrete contained in it back into the material feed container through the thick matter pump itself or under pressure applied in reversed direction with the help of a pressure medium, like compressed air or water, forced into the conveyor pipeline. The physical wiping of the pipelines is done by means of elastomer sponge balls or cleaning members, which are either sucked through the open conveyor pipe end to the material feed container or are forced through suitable pipeline armatures into an opposite direction. It is furthermore known to provide closable cleaning apertures in the pipeline wall in the area of the swivelling pipe, through which apertures access to the inside of the pipeline for cleaning purposes is possible. Not yet satisfactorily solved is the problem of the emptying of the residual concrete existing in the material feed container. Also the handling of the sponge balls during the cleaning of the pipelines leaves much to be desired.

OBJECTS OF THE INVENTION

Starting out from this, the basis purpose of the invention is to improve the known concrete pumps of the above-disclosed type so that the conveyor pipes of the material feed containers can be emptied and cleaned through simple manipulations.

To attain this purpose, it is suggested according to a first modification of the invention, to utilize the cleaning apertures, which already exist in the pipe wall of the conveyor pipe and/or of the swivelling pipe, additionally for feeding the sponge balls into the conveyor or swivelling pipe on the one hand, and/or for emptying the material feed container on the other hand. A cleaning cartridge, which is open on one side toward the cleaning aperture and has at least one compressed air and/or pressure water connection, is connected to the closable cleaning cartridge provided in the pipe wall of the conveyor pipe and/or of the swivelling pipe, whereby the conveyor pipe and/or the swivelling pipe can be closed off on the side of the conveyor cylinder by means of a blocking member. In order to present, during the operating stage of the pump, the thick matter access to the cleaning cartridge, the cleaning cartridge can be advantageously blocked off at the cleaning aperture by means of a blocking member, in particular by a blocking slide. The cleaning cartridge is advantageously hinged in the area of the cleaning aperture to the conveyor pipe or swivelling pipe in such a manner that it can be swung away from the cleaning aperture preferably with the blocking slide being closed thereby freeing the cleaning cartridge frontal opening. The same result can be achieved by rigidly connecting the cleaning cartridge and the blocking member and by being able to move them selectively against the cleaning aperture. It is also possible to connect two cleaning cartridges to the blocking slide, which cartridges can be equipped selectively with sponge balls, cleaning scrapers or with liquid-filled bags.

According to a second modification of the invention, it is also possible to selectively connect a transporting pipe to the cleaning aperture, through which pipe the material feed container can be emptied but for a small residual amount with the help of the conveyor cylinders. A blocking member closing off the conveyor pipe or the swivelling pipe toward the open conveyor pipe end is in this modification additionally provided.

In order to be able to almost completely empty the material feed container, it is suggested according to a preferred or alternative development of the invention that the front-side conveyor cylinder openings opening into the material feed container can be covered or closed off adjacent the container base preferably by means of a slide at least partially against the entry of air from the material feed container.

The blocking member can be designed, for example, as a blocking slide, which is advantageously arranged in the area of a connecting flange on the side of the conveyor pipe outside of the material feed container.

The blocking member can also be designed as a sealing member, which can be pressed into the inside of the pipe against the conveyor pipe or swivelling pipe wall, and can be deformed preferably under the action of pressure, and which sealing member can be guided from the cleaning cartridge into the conveyor or swivelling pipe and can be positioned in same preferably by means of a flexible, band-like or chainlike holding member. In order to assure that the sealing member is not unintentionally forced out of the conveyor pipe or the swivelling pipe, it is possible to provide independent of the holding member or in addition thereto, a seat or support member for the sealing member, which seat or support member engages the inside of the pipe, preferably from the cleaning aperture. A preferred embodiment of the invention provides that the sealing member is designed as a ball or balloon, which can be expanded under the action of a pressurized medium, preferably compressed air or pressurized liquid, and can be pressed against the inside surface of the pipe.

BRIEF DESCRIPTION OF THE DRAWINGS

The invention will be discussed in greater detail hereinafter in connection with some exemplary embodiments schematically illustrated in the drawings, in which.

DETAILED DESCRIPTION

Figure 1:
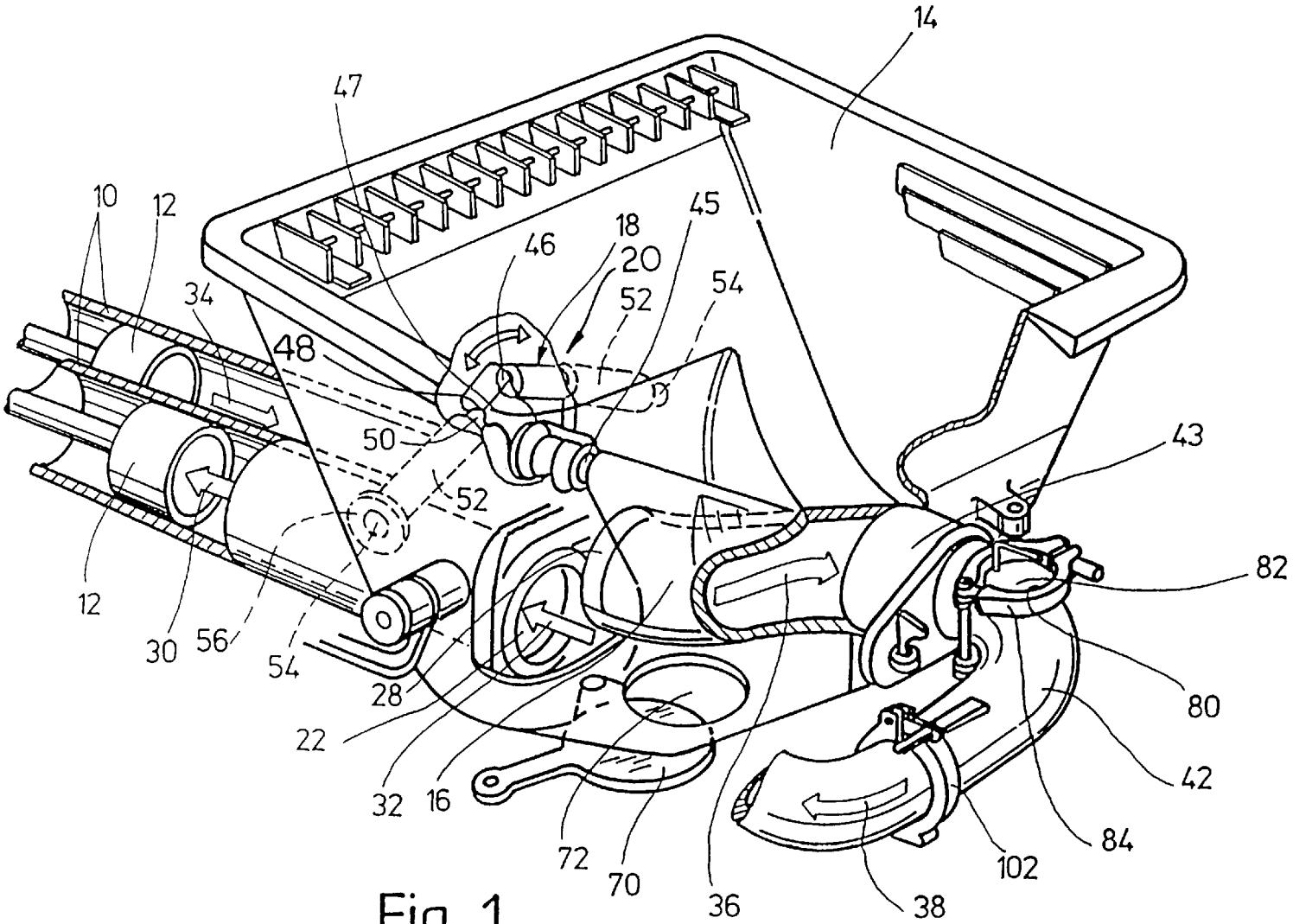
FIG. 1 is a diagrammatic illustration of a thick matter pump with an S-shaped swivelling pipe.

The two-cylinder thick matter pumps illustrated in the drawings are intended for use in stationary and movable concrete pumps. They consist essentially of two conveyor cylinders 10 with conveyor pistons 12 driven hydraulically in a push-pull action, a material feed container 14 and a slide mechanism 20 slidingly engaging a swivelling pipe 16 to the material feed container 14, and operable with a reversing mechanism 18. The conveyor cylinders 10 are connected in the lower area through front-side openings 22 to the back wall 24 of the material feed container 14, whereby the openings 22 on the inside of the material feed container 14 are defined by a wearing plate 26 formed like spectacles. The swivelling pipe 16 rests with its one end carrying a wear ring 28 thereon against the wear plate 26, and is swivelled by the reversing mechanism 18 dependent on the direction of movement of the conveyor pistons 12 in the conveyor cylinders 10 in front of the one or the other opening 22. Material is in this manner, with the conveyor piston 12 being moved back in direction of the arrow 30, sucked from the material feed container 14 through the opening 22 in direction of the arrow 32 into the respective conveyor cylinder 10, whereas material is transported through the other conveyor piston 12 in direction of the arrows 34, 36, 38 through the swivelling pipe 16 into a conveyor pipe 42 provided outside of the material feed container 14. The conveyor pipe 42 can be connected to a conveyor pipeline (not illustrated) of a concrete-distributing mast.

Figure 3:
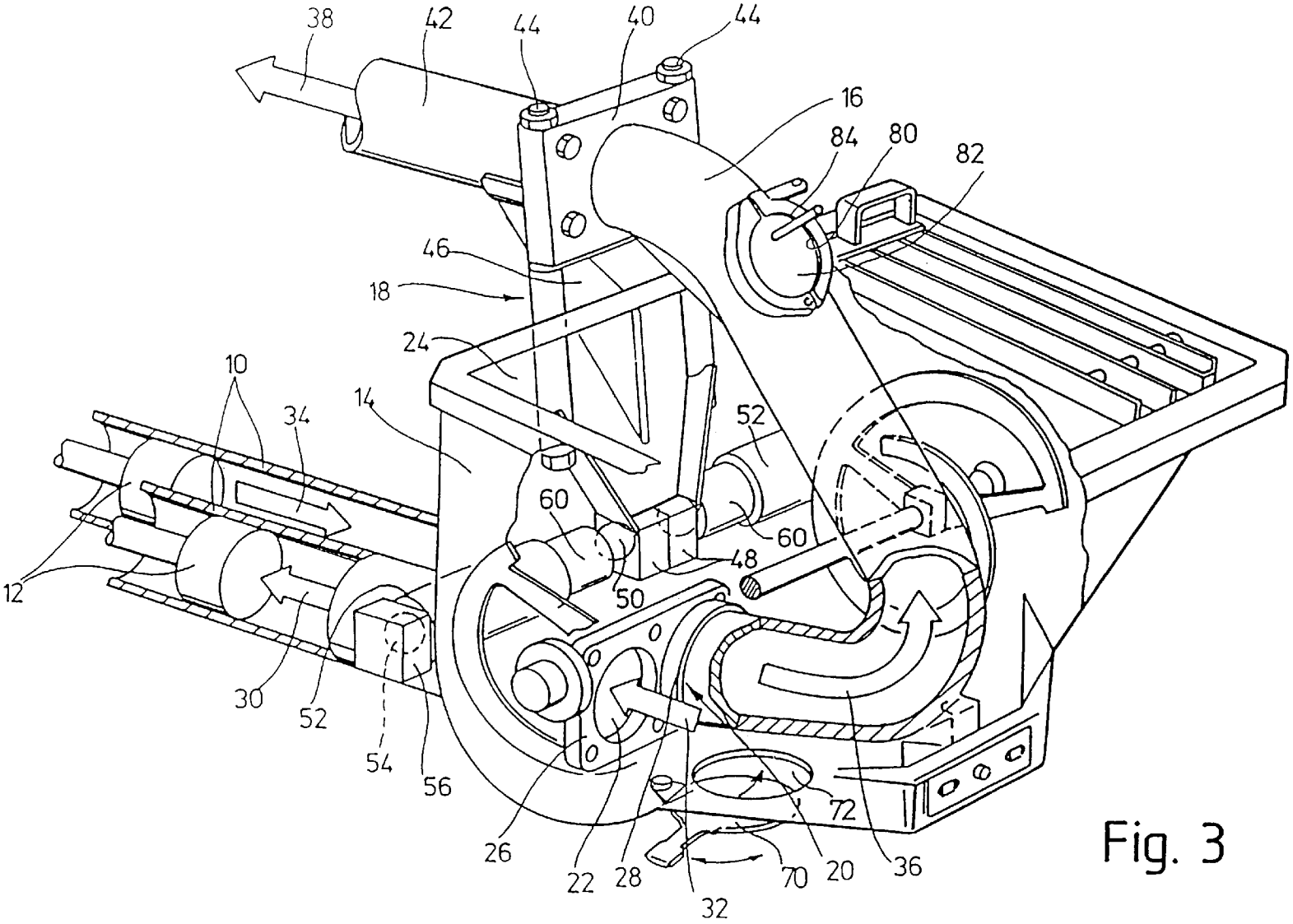
FIG. 3 is a diagrammatic illustration of a thick matter pump with a C-shaped swivelling pipe.

The exemplary embodiments illustrated in FIGS. 1 and 3 differ mainly in the shape of the swivelling pipe 16. The swivelling pipe is designed essentially S-shaped in the exemplary embodiment according to FIG. 1. It is connected at its end opposite the conveyor cylinders through a container-fixed connection 43 coaxial with respect to its swivel axis to the conveyor pipe 42, and extends on the other side with a shaft 45 designed as a driving shaft through a pivot bearing 47 of the material feed container 14. The outwardly projecting shaft end of the shaft 45 is connected fixed against rotation to a reversing lever 46 of the reversing mechanism 18, which has at its upwardly pointing end two bearing points 48, which point to opposite sides and are designed as ball sockets, for the connection of a piston-side ball end 50 of the two driving cylinders 52 of the reversing mechanism 18. The driving cylinders 52 are supported on the cylinder side with a further ball end 54 in a bearing point 56 fixed on the conveyor cylinder and designed as a ball socket.

Different from the above, the exemplary embodiment illustrated in FIG. 3 has a C-shaped swivelling pipe 16, which engages from above the material feed container 14. The swivelling pipe 16 is connected through a flange 40 to the conveyor pipe 42 designed as an extension pipe, which in turn is connected through a pipe revolving joint (not illustrated) to a conveyor pipeline of a concrete-distributing mast. The flange 40 is releasably connected by means of two clamping screws 44 to the reversing lever 46 of the reversing mechanism 18, which has at its lower end two bearing points 48, which are oriented toward opposite sides and are designed as ball sockets, for the connection of a piston-side ball end 50 of the two driving cylinders 52 of the reversing mechanism 18. The driving cylinders 52 are on the side of the cylinders supported with a further ball end 54 in a bearing point 56 fixed on the conveyor cylinder and designed as a ball socket. The driving cylinders 52 can be loaded on one side with pressurized oil and contain a plunger piston 60 carrying the ball end 50.

The pipelines of the thick matter pump and of the material feed container must be emptied and cleaned at the end of a conveying operation. Cleaning apertures 80 are, for this purpose, provided in the area of the pipe walls of the swivelling pipe 16 (FIG. 3) and/or of the conveyor pipe 42, which apertures can be closed off by a lid 82 and a coupling member 84.

As can be seen from FIGS. 2*a*, 2*b*, 2*c* and 4 to 6, an essentially cylindrical cleaning cartridge 86 can be connected selectively to the cleaning apertures 80, which cleaning cartridge has cleaning members 88, 88' or liquid bags 88" and can be loaded with pressurized water or compressed air through connections 90, 92. In order to be able to move the cleaning members 88, 88' and the liquid bag 88" with the pressurized water or the compressed air through the conveyor pipe 42 and the following conveyor pipeline taking along the concrete therein, a shutoff device is additionally provided on the side of the conveyor cylinder, which in the case of FIGS. 2*a*, 2*b* and 2*c* and 4*a* is designed as a blocking slide 94, 96 and in the case of FIG. 5 as an inflatable balloon 98, which can be pressed on the inner surface of the swivelling pipe 16.

Figure 2A:
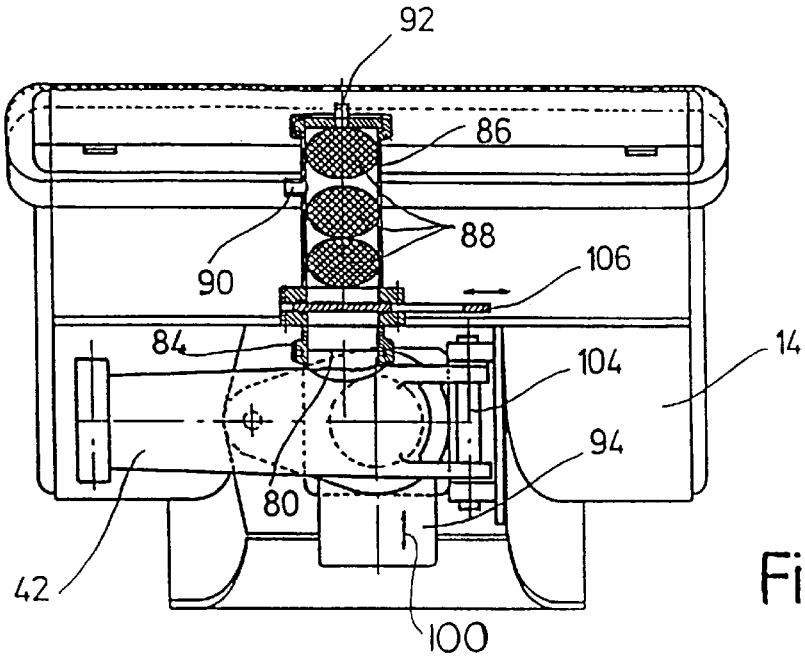
FIGS. 2*a* and 2*b* are rear views of two modified embodiments of a thick matter pump corresponding to FIG. 1 having a cleaning cartridge.
Figure 2B:
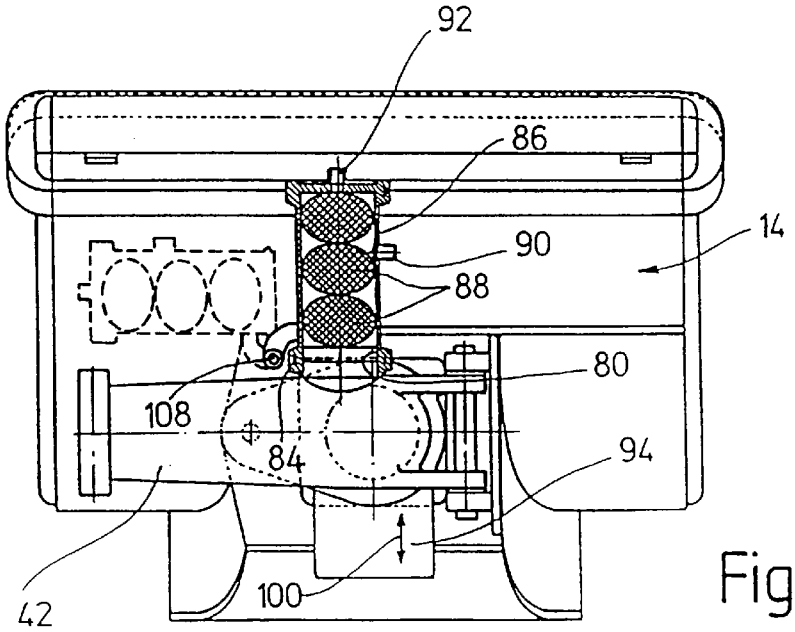
Figure 2C:
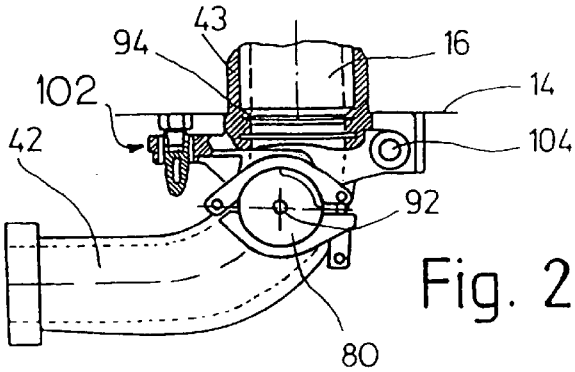
FIG. 2*c* is a top, partially cut away view showing the cleaning aperture.

The blocking slide 94 according to FIGS. 2*a*–2*c* is provided in the area of the pipe revolving joint 43, and is arranged to be vertically movably in direction of the double arrow 100. The cleaning aperture 80 for the connection of the cleaning cartridge 86 is provided on a conveyor pipe section 42 designed as a collapsible pipe, which section can, after the release of the snap closure 102, be pivoted about the joint 104 releasing the pipe revolving joint 43 for cleaning purposes. The cleaning cartridge 86 has, in the exemplary embodiment according to FIG. 2*a*, a blocking slide 106, which is closed during the conveying operation and can be moved into its open position during the cleaning operation.

As an alternative or in combination therewith, the cleaning cartridge 86 is in the exemplary embodiment according to FIG. 2*b* pivotal about the joint 108 relative to the cleaning aperture 80, after the coupling member 84 has first been removed. The opening of the cleaning cartridge 86 is in this manner released with few manipulations for insertion of the cleaning members 88.

Figures 4A, 4B, 4C:
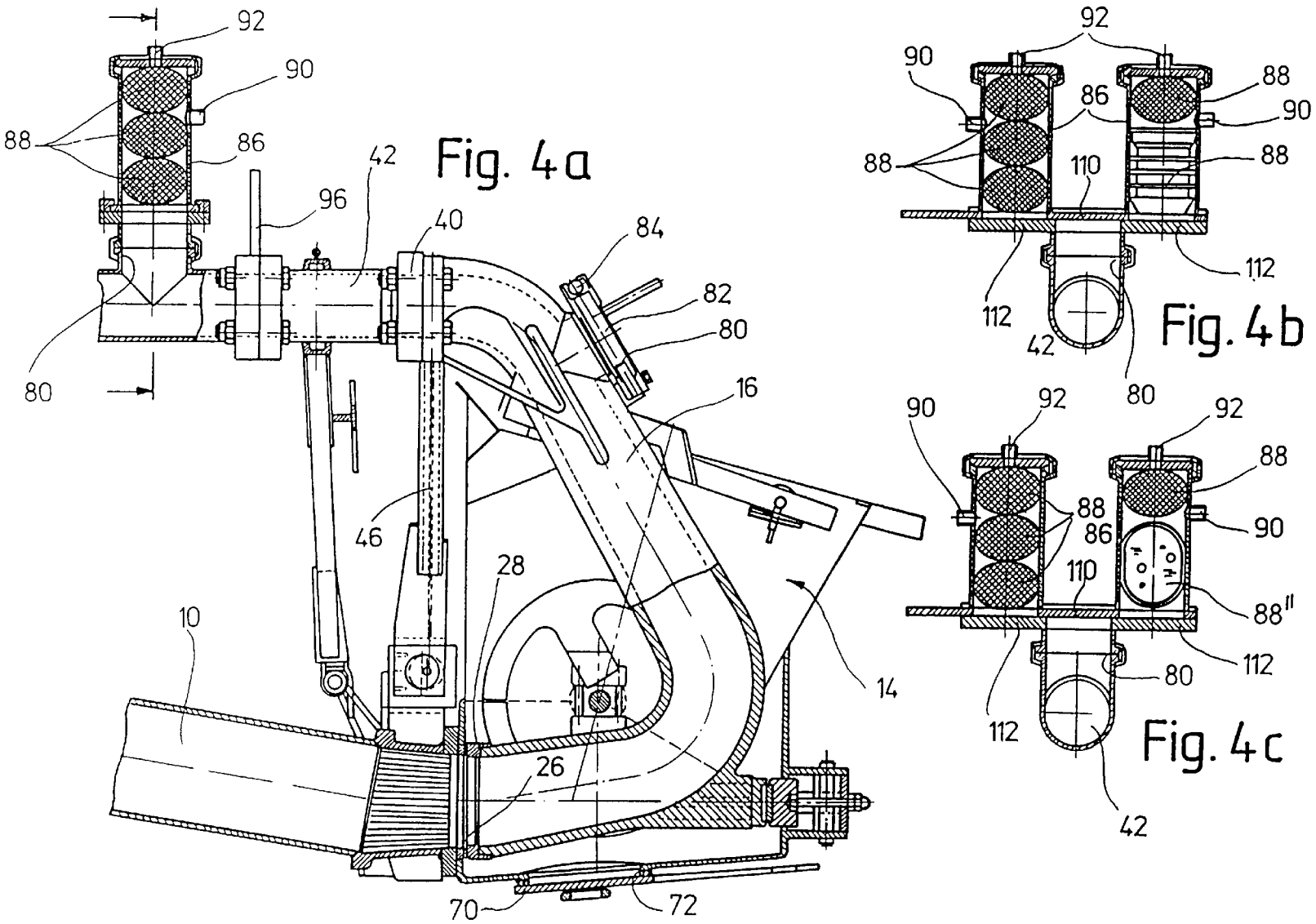
FIG. 4*a* is a side view of the thick matter pump according to FIG. 3 in a partially cross-sectional illustration.
FIGS. 4*b* and 4*c* are cross-sectional views of the cleaning cartridge along the cross-sectional line IV—IV of FIG. 4*a* with a variable filling thereof.

The exemplary embodiment shown in FIGS. 4*a* to 4*c* provides a cartridge slide 112 consisting of two cleaning cartridges 86 and one slide plate 110 connected together, which cartridge slide is flanged to the cleaning aperture 80 of the conveyor pipe 42. One of the cartridges 86 or plate 110 is positioned over the aperture 80. By moving the cleaning cartridges 86 laterally beyond the base plate 112, the cleaning members 88, 88', 88" can be inserted from below into the cleaning cartridges 86.

The blocking slide 96 in the conveyor pipe 42 is first closed during the cleaning operation. Then one of the cleaning cartridges 86 is moved over the cleaning aperture 80 and is temporarily pressurized with water at the connection 90 so that two of the three cleaning members 88 are pressed into the pipeline. The water connection is subsequently closed and the third cleaning member 88 is pressed with compressed air through the connection 92 into the conveyor pipeline. A discharge block (not illustrated) is mounted at the end of the conveyor pipeline so that the concrete and the cleaning members can escape without any danger out of the conveyor pipeline.

As can be seen in FIG. 4*c*, the cleaning cartridges 86 can also be used as a pump-priming aid such that a bag 88" filled with a lubricating and sliding medium is pressed by water into the conveyor pipeline and is subsequently pumped with the concrete to the outlet of the conveyor pipeline. The bag 88" breaks open and thereby distributes its content onto the inner surface of the conveyor pipeline.

Figure 5:
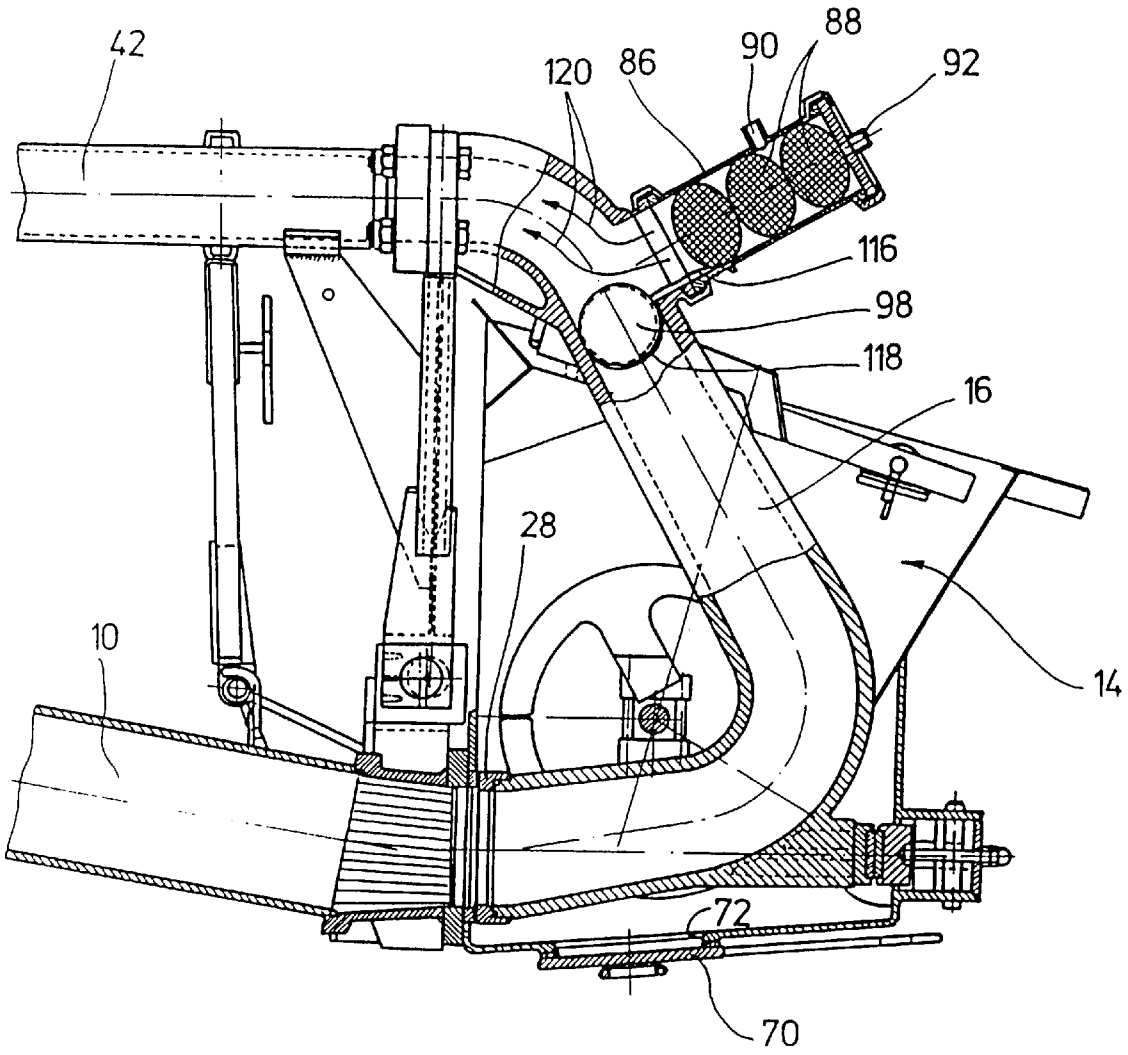
FIG. 5 is an illustration corresponding to FIG. 4*a* with a cleaning cartridge flanged to a cleaning aperture of the swivelling pipe.

The cleaning cartridge 86, in the exemplary embodiment illustrated in FIG. 5, is connected to the cleaning opening 80 of the C-shaped swivelling pipe 16. In order to block the return path to the material feed container 14 during the cleaning operation, an inflatable balloon 98 is inserted into the inside of the swivelling pipe 16, which balloon is fixedly connected on a band 116 to the cleaning cartridge 86 and is supported toward the side of the conveyor cylinder in a seat 118 especially provided for this purpose. The two front cleaning members 88 are, during the cleaning operation, first forced with pressurized water through the connection 90 in the direction of the arrows 120 into the conveyor pipe 42 in order to be subsequently forced, after the water supply has been turned off, together with the third cleaning member 88 through the concrete column provided in front of it toward the outlet of the conveyor pipeline.

It is possible in all exemplary embodiments to return the cleaning members into the material feed container 14 to again wipe clean the conveyor pipeline from the conveyor pipeline end when the conveyor pump 10, 12 is switched over to a suction operation with the blocking member 94, 96, 98 being in an open position. The last conveyor pipe section 42 leading to the material feed container together with the swivelling pipe 16 is in this manner also cleaned.

An opening 72, which can be closed off with a swivel lid 70 and through which the material feed container 14 can be completely emptied, is provided in the underside of the material feed container 14.

Figure 6B:
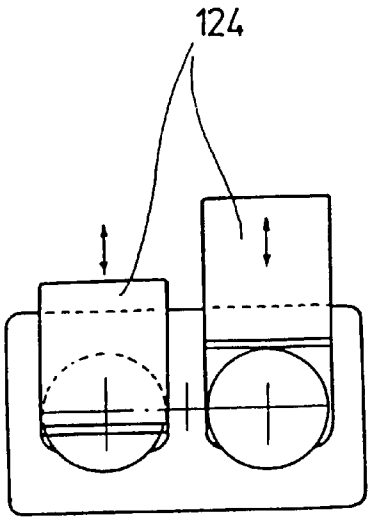
FIG. 6*b* is a front side view of the limiting slide according to FIG. 6*a*.
Figure 6A:
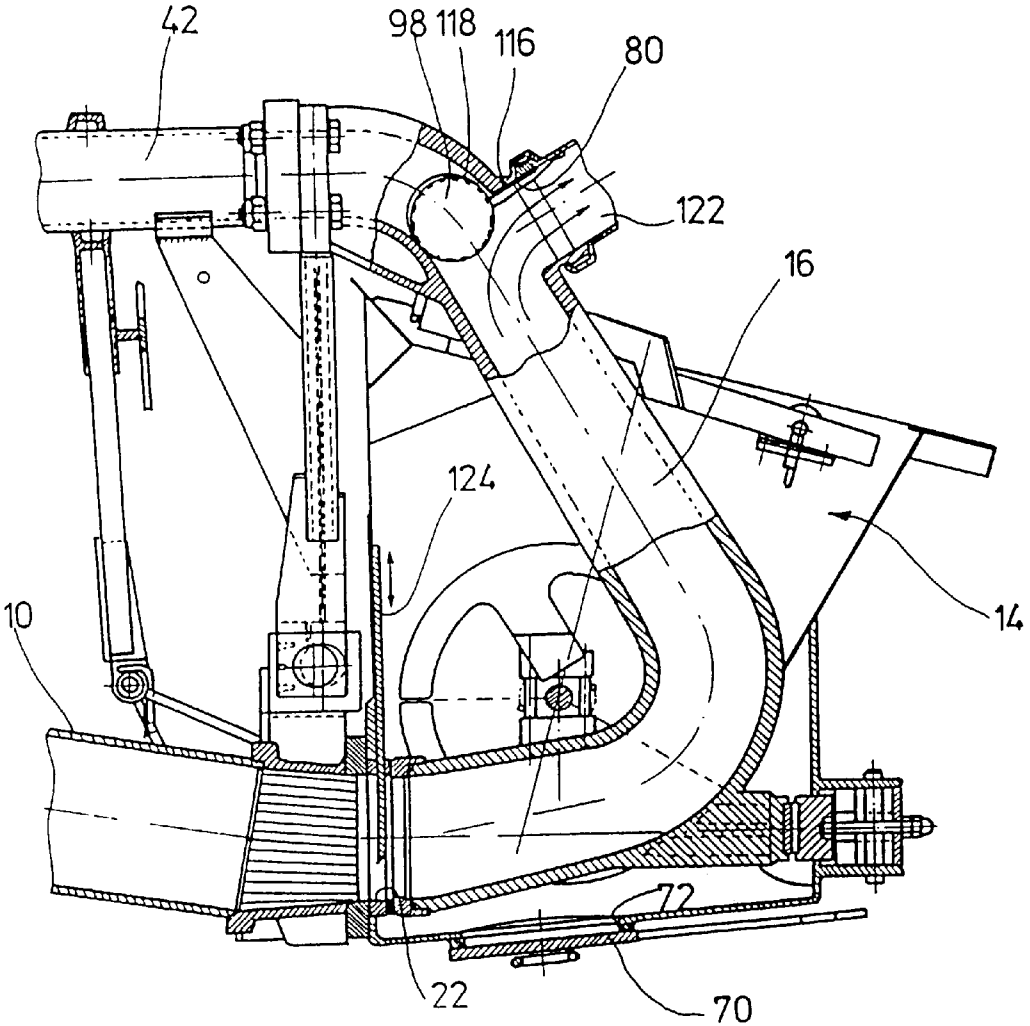
FIG. 6*a* is an illustration corresponding to FIG. 5 with a transporting pipe flanged to the swivelling pipe and with limiting slides on the conveyor cylinder side.

The material feed container 14 can, in the exemplary embodiment illustrated in FIGS. 6*a* and 6*b*, also be emptied through the concrete pump. The cleaning aperture 80 on the swivelling pipe 16 is, for this purpose, equipped with a pressure hose 122 and the path to the conveyor pipe 42 is blocked by the balloon 98. If the slides 124, which are arranged in the area of the wearing plate 26 formed like spectacles and are movable from the top downwardly, are positioned so that during suction only the lower area of the conveyor cylinder openings 22 is open toward the material feed container 14, the material feed container can be almost completely emptied. The residual concrete still can be removed through the opening 72.

In conclusion the following can be stated: The invention relates to a thick matter pump, in particular a concrete pump, with a material feed container 14, two conveyor cylinders 10 ending with their front-side openings 22 opening into the inside of the material feed container 14, a swivelling pipe 16 extending into the material feed container 14, communicating with its one end alternately in pulses with the front-side openings 22 in the conveyor cylinders, and being connected with its other end to a conveyor pipe 42, and with a closable cleaning aperture 80 arranged in the appropriate pipe wall adjacent the end of the conveyor pipe 42 on the side of the swivelling pipe or in a section of the swivelling pipe 16 arranged outside of the material feed container. According to the invention, a cleaning cartridge 86 can be connected to the cleaning aperture 80, which cartridge has a compressed air and/or pressure water connection 90, 92, whereas the conveyor pipe 42 and/or the swivelling pipe 16 can be closed off on the side of the conveyor cylinder by means of a blocking member 94, 96, 98.

We claim:

1. In a thick matter pump including a material feed container having a material receiving interior, two hydraulically driven conveyor cylinders each having front-side openings opening into the interior of the material feed container, a pipe having a first end extending into the material feed container and being configured to swivel within said material feed container, the first end communicating alternately with the front-side openings, the pipe conveying thick matter from said conveyor cylinders to a desired location, a closable cleaning aperture arranged in a pipe wall of said pipe, the improvement wherein a cleaning cartridge is connectable only onto an outside of the pipe wall, said cleaning cartridge being open on one side toward the cleaning aperture and has at least one of a compressed air connection and a pressurized water connection, and wherein a blocking member closes off said pipe between said conveyor cylinders and said cleaning aperture.

2. The thick matter pump according to claim 1, wherein the cleaning cartridge has a hollow interior that extends radially relative to the longitudinal axis of the pipe, and a blocking slide blocks off the interior of the cleaning cartridge toward the cleaning aperture and is configured to slide perpendicular to the interior of said cleaning cartridge.

3. The thick matter pump according to claim 2, wherein at least one said cleaning cartridge and the blocking slide are rigidly connected to one another and are selectively movable against the cleaning aperture.

4. The thick matter pump according to claim 1, wherein the conveyor cylinders respectively include slides at the front-side conveyor cylinder openings, the slides at least partially covering said front-side conveyor cylinder openings against entry of air from the material feed container into the conveyor cylinders.

5. The thick matter pump according to claim 1, wherein the blocking member is a blocking slide.

6. The thick matter pump according to claim 5, wherein the material feed container has a connecting flange on the outside thereof, and the blocking slide is arranged adjacent to said connecting flange on the side of the pipe outside of the material feed container.

7. The thick matter pump according to claim 1, wherein the blocking member includes a sealing member, the sealing member is adapted to be pressed against an inside of the pipe, and is deformable under the action of pressure thereagainst.

8. The thick matter pump according to claim 7, wherein the sealing member is adapted to be guided from the cleaning cartridge into the pipe and includes one of a flexible band and chainlike holding member positioning said sealing member in said pipe.

9. The thick matter pump according to claim 7, wherein the sealing member is one of a balloon and a ball, the sealing member is expandable under the action of a pressurized medium, and the sealing member is adapted to be pressed against the inside surface of the pipe.

10. The thick matter pump according to claim 7, wherein the pipe includes one of a seat and support member for receiving thereon the sealing member when the sealing member extends into the interior of the pipe.

11. The pump according to claim 1, wherein said cleaning aperture only extends radially through one area of said pipe wall, and said cleaning cartridge extends radially in one direction from said pipe wall.

12. The pump according to claim 1, wherein said pipe includes a swivelling section and a conveying section, said swivelling section having first and second ends, said swivelling section first end being alternately connected to one of said front-side openings, said conveying section having a connected end connected to said swivelling section second end and transporting material to a desired location.

13. The thick matter pump according to claim 12, wherein a transporting pipe, which is open toward the cleaning aperture, is connectable from the outside to the pipe wall, and wherein at least one of the conveyor section and the swivelling section is closed off toward a free end of the conveyor section by said blocking member.

14. The pump according to claim 12, wherein said cleaning aperture is in said swivelling section adjacent said connected end of said conveying section.

15. The pump according to claim 12, wherein said cleaning aperture is in said swivelling section outside said material feed container.

16. The pump according to claim 12, wherein said cleaning aperture is in said conveying section.

17. In a thick matter pump including a material feed container, two hydraulically driven conveyor cylinders each having front-side openings opening into an inside of the material feed container, a pipe having a first end extending into the material feed container and being configured to swivel within said material feed container, the first end communicating alternately with the front-side openings, the pipe conveying thick matter from said conveyor cylinders to a desired location, a closable cleaning aperture arranged in a pipe wall of said pipe, the improvement wherein a cleaning cartridge is connectable onto an outside of the pipe wall, said cleaning cartridge is open on one side toward the cleaning aperture and has at least one of a compressed air connection and a pressurized water connection, wherein a blocking member closes off said pipe between said conveyor cylinders and said cleaning aperture, and wherein the cleaning cartridge is connected by a hinge in the area of the cleaning aperture to the pipe so that the cleaning cartridge is pivotable away from the cleaning aperture freeing access to the one side of the cleaning cartridge.

18. A thick matter pump including a material feed container, two hydraulically driven conveyor cylinders each having front-side openings opening into an inside of the material feed container, a swivelling pipe having first and second pipe ends, said first pipe end extending into the material feed container and being configured to communicate alternately in pulses with the front-side openings, a conveyor pipe having input and output ends, said input end being connected to said second pipe end, and a closable cleaning aperture arranged in a pipe wall of the swivelling pipe and adjacent the input end of the conveyor pipe, wherein a transporting pipe, which is open toward the cleaning aperture, is connectable from the outside to the pipe wall, wherein a blocking member closes at least one of the conveyor pipe and the swivelling pipe at the input end, and wherein movable slides are respectively at the front-side openings for at least partially covering the front-side openings so as to prevent air from entering the conveyor cylinders when the material feed container has a low amount of material.

* * * * *